US005540021A

United States Patent [19]

Daneshvar

[11] Patent Number: 5,540,021

[45] Date of Patent: Jul. 30, 1996

[54] FUN FLOORS

[76] Inventor: Yousef Daneshvar, 21459 Woodfarm, Northville, Mich. 48167

[21] Appl. No.: 82,969

[22] Filed: Jun. 29, 1993

[51] Int. Cl.[6] ..... E04B 5/43; E04B 5/46

[52] U.S. Cl. ..... 52/263; 52/169.7; 52/632; 52/7; 52/455; 108/27; 4/494; 4/498

[58] Field of Search ..... 52/263, 126.5, 52/632, 7, 169.7; 248/354.5, 188.5; 198/851; 182/39; 160/133; 4/498, 503, 494; 108/23, 27

[56] References Cited

U.S. PATENT DOCUMENTS

| | | | |
|---|---|---|---|
| 592,657 | 10/1897 | Mason | 198/851 |
| 1,437,205 | 11/1922 | Sheffield | 160/133 |
| 1,678,971 | 7/1928 | Bergesen | 52/263 |
| 2,659,902 | 11/1953 | Fitzgerald et al. | 182/39 |
| 2,691,782 | 10/1954 | West | 198/851 |
| 3,009,166 | 11/1961 | Sears | 4/498 X |
| 3,356,329 | 12/1967 | Santo | 248/354.5 |
| 3,391,410 | 7/1968 | Melberg | 4/503 |
| 3,523,308 | 8/1970 | Bradley | 4/503 |
| 3,766,691 | 10/1973 | Ray | 52/169.7 X |
| 3,827,665 | 8/1974 | Kistler | 248/354.5 |
| 4,051,638 | 10/1977 | Heintz | 4/498 X |
| 4,136,408 | 1/1979 | Dahlbeck et al. | 4/498 |
| 4,467,730 | 8/1984 | Borichevsky | 108/57 X |
| 4,610,119 | 9/1986 | Bench | 52/455 |
| 4,805,541 | 2/1989 | Drane et al. | 108/27 |
| 4,876,969 | 10/1989 | Infanti | 108/23 X |
| 5,303,527 | 4/1994 | Perez et al. | 4/494 X |
| 5,353,717 | 10/1994 | Taylor | 108/157 |

FOREIGN PATENT DOCUMENTS

| | | | |
|---|---|---|---|
| 354759 | 6/1922 | Germany | 52/7 |
| 537779 | 1/1956 | Italy | 52/632 |

*Primary Examiner*—Carl D. Friedman
*Assistant Examiner*—Wynn E. Wood

[57] ABSTRACT

Floor structures that are erected on a temporary basis on ground so that they can be removed and not do permanent damage to the environment. In one embodiment a frame is mounted on poles that are staked into the ground. The floor has sections that extend between sides of the frame and are connected together to move in unison to be extended for use and retracted for storage. Such extension and retraction may be motorized. In another embodiment a glass floor structure bridges a pool and steps provide access for people.

9 Claims, 6 Drawing Sheets

FUN FLOORS

THE BACKGROUND OF THIS INVENTION

Physical activity, exercise, playing certain games and outdoor activities are important parts of a person's life. However, they are not possible all the time since the appropriate place is not available everywhere. One problem with making exercise places is that for making it, nature has to be disturbed and grass is destroyed and eliminated to be replaced with cement or asphalt (to make a play ground such as tennis court) or similar hard things. This application introduces play grounds and decks that are to be set up on temporary basis. They are designed to be placed on top of grass, over the driveways, above the pools, on uneven places, etc, so that nature and the underlying ground would not be disturbed permanently. They also have other uses such as setting up a tent safely and enjoying from such units in any possible way.

THE BRIEF EXPLANATION OF INVENTION

This invention deals with making portable flat surfaces which have many uses such as playgrounds and decks that are to be placed on the ground, over the grass, on driveways and pools etc. This unit is totally or partially portable and is intended to occupy the lands that can be then used for their own purpose. These surfaces and the play grounds will be installed and used on some temporary basis then to be moved back by manual or mechanical techniques to allow the place to be returned more or less to its previous condition. In general, four or more adjustable poles will be used to hold one or more rectangular frames made from hard materials such as aluminium, steel or similar durable material. This flat frame will hold pieces of durable materials such as pieces or sections of wood, metal, plastics or combinations of them to be joined to allow assembling a large or small flat surface, deck or playground. After such hard basic sections are put in place, then one or more layers of rubber or plastic will be used to cover the hard base to let the place have a nice cover and needed texture for the purpose of use. Although the smaller units and some models will be assembled manually, this unit can be made to have a motorized model as well to allow the moving of the parts to be done by electrical engines to simplify the moves and to decrease needed labor. These units will be made in pre-designed shaped parts and will come with related instruction and pieces to make this job easily possible and affordable.

DETAILED DESCRIPTION OF THE FIGURES

Figure 1:
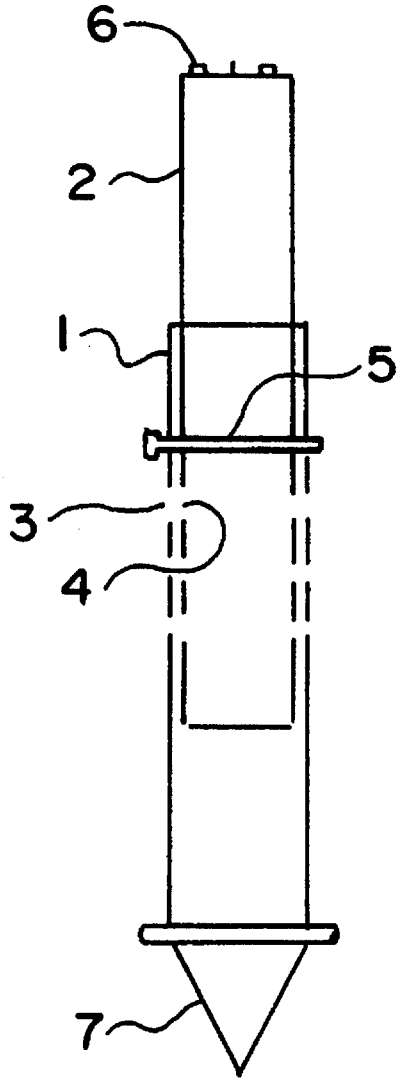
FIG. 1. This figure shows the cross-cut view of a pole that has a mechanism of adjustability, as well as one sharp bottom end.
Figure 2:
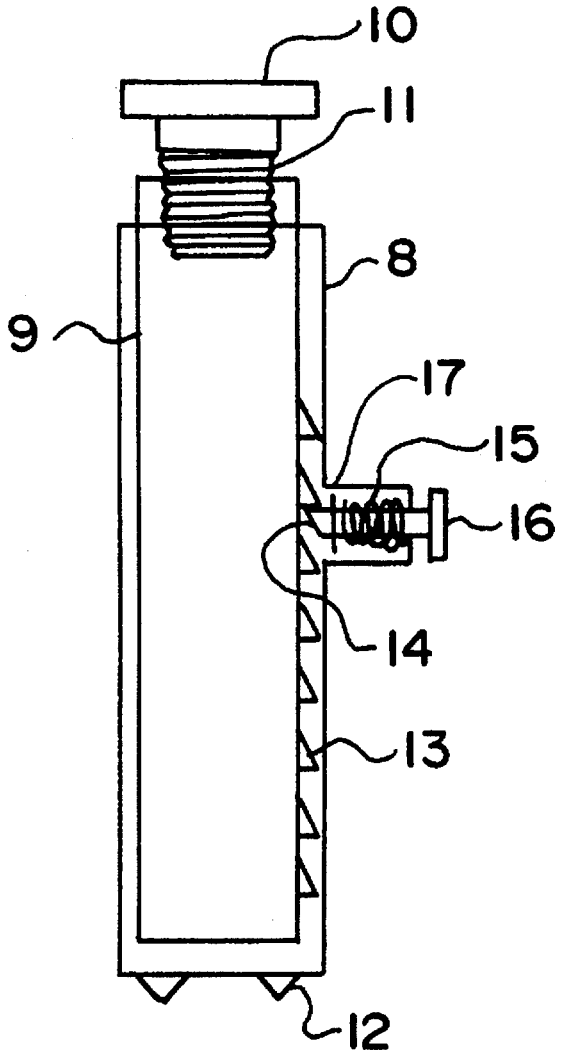
FIG. 2. This figure shows the cross-cut view of a pole that has another mechanism of adjustability, as well as a lower end with more than one sharp piece, and an adjustable top piece.

FIG. 1. This figure shows the cross-cut view of a pole that has a mechanism of adjustability. This figure shows the bottom of this pole with a sharp point on it to make it possible to stick to the floor or ground for stability. A central piece of this unit is inside an outside matching shell. These pieces have matching holes that allow a metal bar to go through to keep the length under control. The top of this unit has a couple raised spots to accept matching holes from the flames in order to hold them securely. In this figure the outer shell is shown by 1 and the inner piece of the pole by 2. The matching holes from shell by 3 and from inner piece by 4. The metal bar by 5. The sharp point of the outside piece by 7. The raised spots of the top of this pole by 6. FIG. 2. This figure shows the cross-cut view of a pole that has another mechanism of adjustability. This figure shows the bottom of this pole with a couple of sharp points on it to make it possible to stick on floor or ground. A saw tooth shaped piece is covering one side of the inner piece which is facing a block from the outside shell. The brake is pushed by a spring and can be pulled by a handle. This system will allow the inner piece to be pulled out, but not to be able to return unless the break is released by being pulled out with its handle. In the top of this unit, the pole has a head that is connected to the inner piece by a screw type mechanism that allows it to be rotated for fine adjustment of the height. In this figure the outer shell is shown by 8 and the inner part by 9, one saw tooth by 14 The tip of brake by 14 and its handle by 16. The spring which pushes the brake in by 15. The outer cover of the brake by 17, the sharp pieces of the lower end of the pole by 12. The upper end by 10 and the screw piece of it by 11.

Figure 3:
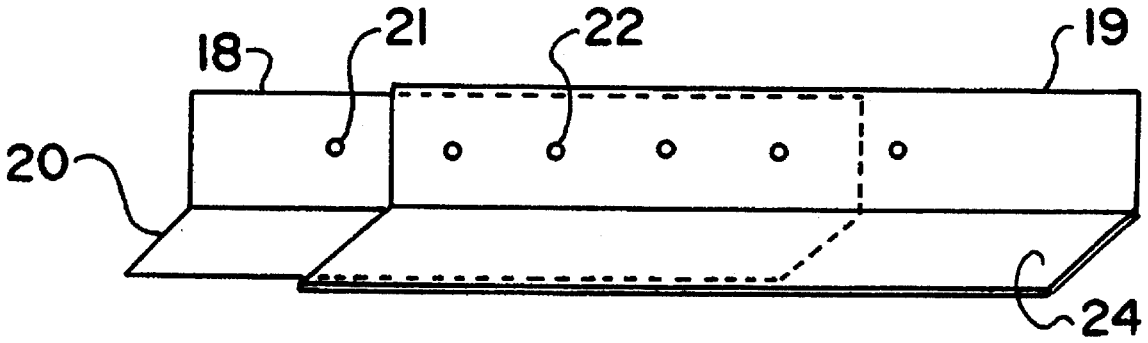
FIG. 3. This figure shows two pieces of simple frames that match and fit each other and can slide inside one another to be adjusted.
Figure 4:
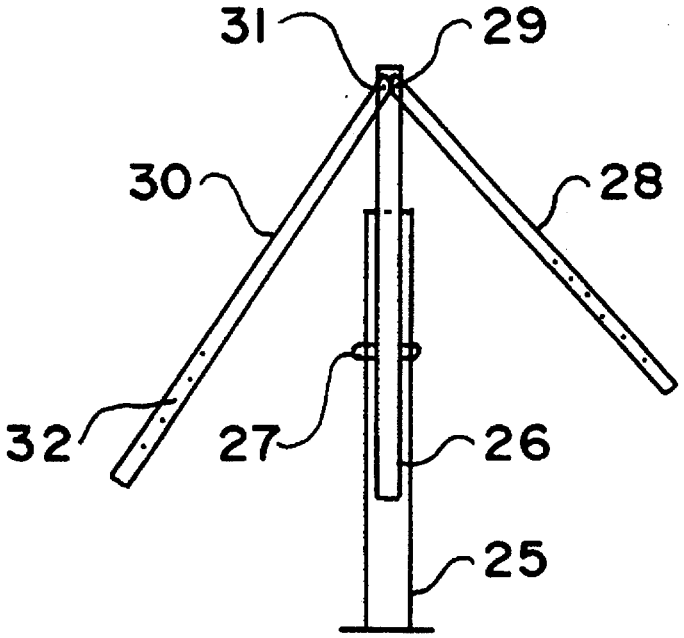
FIG. 4. This figure shows a special pole that has an adjustable height as well as pieces of frames connected to it.
Figure 5:
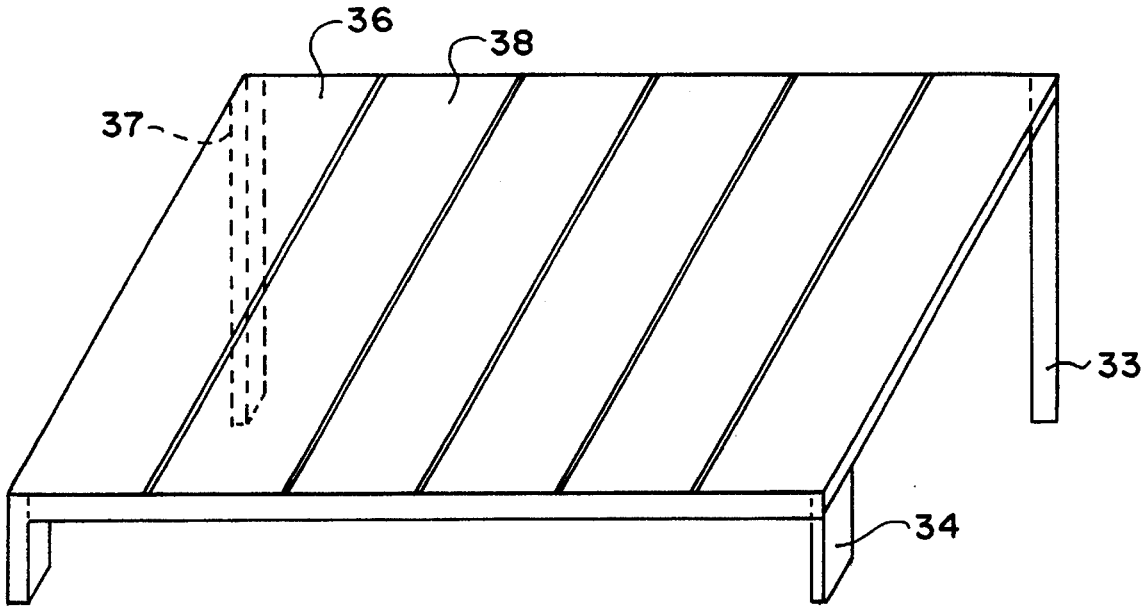
FIG. 5. This figure shows a unit that is a simple example of a table or a flat surface that can be set up on an uneven place.
Figure 6:
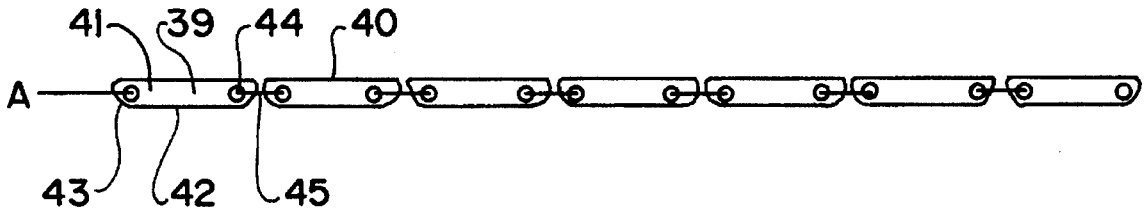
FIG. 6. This figure shows the side view of a sectional surface cover that is pulled by A to make a flat surface.

FIG. 3. This figure shows two pieces of simple frames that match and fit each other; also, they have holes that can be held next to each other to allow screws to go through and hold them together tightly. This is to simply show how the length of the flames can be adjusted easily. In this figure, one piece of the frame is shown by 18 and 20 (18 is vertical part of it and the 20 is the horizontal part of it. The other one by 19 and 24 and matching holes by 22 and one hole from the first piece by 21. FIG. 4. This figure shows a special pole that has an adjustable height by having two pieces: one inner piece that goes into another outer shell-like piece. The outside shell piece has holes that allow a small piece of metal pushed by a spring to go into these to hold them to be stable. Since there are many of those holes in the sides of the outer shell all along, the height can be adjusted. The top of the center piece is connected also to two pieces of frames, one in each side; these are hinged so that when they are being stored or moved they could be held next to the pole and when they are set up then, these frames will be raised to stand in proper position to match the frame from the other pole and be screwed or fixed temporarily into it. In this figure, the outer shell of the pole is shown by 25 and inner piece by 26, the piece that goes from inner piece and thorough the hole in outer shell by 27. The frames by 28 & 29 and one hole of one frame by 32. The frame 28 is connected to the pole with hinge 29 and the frame 30 is connected to the pole by hinge 31. FIG. 5. This figure shows a unit that is a simple example of table or a flat surface that is set up in an uneven place. This figure shows how the poles of this table are adjusted to have the needed lengths which are different (the technique of adjustability is not shown here as well as the frames are not clearly shown here). This figure shows that the rear two poles are longer than the front poles (legs). Even the left rear pole of 37 is longer than the right rear pole of 33. The front right pole of 34 is the shortest. This figure also shows the top cover of this special table which is made from sections of pieces that are set one next to the other. Two of these pieces no 36 and 38 are shown in this figure. FIG. 6. This figure shows the side view of a sectional surface cover that is already pulled by piece A, and has spread on the appropriate frame (not shown in this figure). In this view, individual pieces are shown with their respected wheels in each side, as well as their connection of one piece to the piece next to it. This view shows the top surface of these units to be flat and straight; however, the lower surface has a curved edge to facilitate turning. In this figure the pulling part is shown by A and the first section or board by 39 the front wheel of this section by 43 the top surface of the first section by 41 and the lower surface of the first section by 42. The rear wheel of the first section by 44. The second section by 40 the connection between the first section of 39 and second section of 40 by piece 45.

Figure 7:
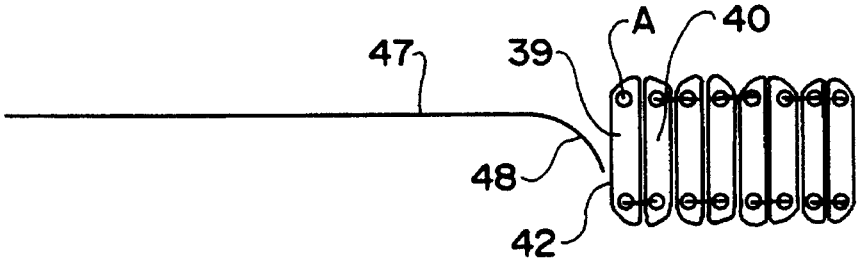
FIG. 7. This figure shows the side view of a sectional unit similar to the one shown in previous figure of 6. except here it is pushed to be compact for storage.

FIG. 7. This figure shows the side view of a sectional unit similar to the one shown in previous figure of 6. except this view shows how these sections can be pushed to stand in a smaller place for storage purposes. This figure also shows the individual pieces of these units with their respected wheels in each side, as well as their connection of one piece to the piece next to it. It is shown that in this model the top surface of these units are flat and straight while the lower surface has a curved edge to facilitate turning. Also in this figure the ramp that will allow pulling these sections to the surface of the frame is shown. In this figure the first section is shown by 39 with the piece for pulling by A the lower surface of the first section by 42. The second section by 40. The ramp for directing the motion of the sections by 48 and the surface of the frame by simple line of 47.

Figure 8:
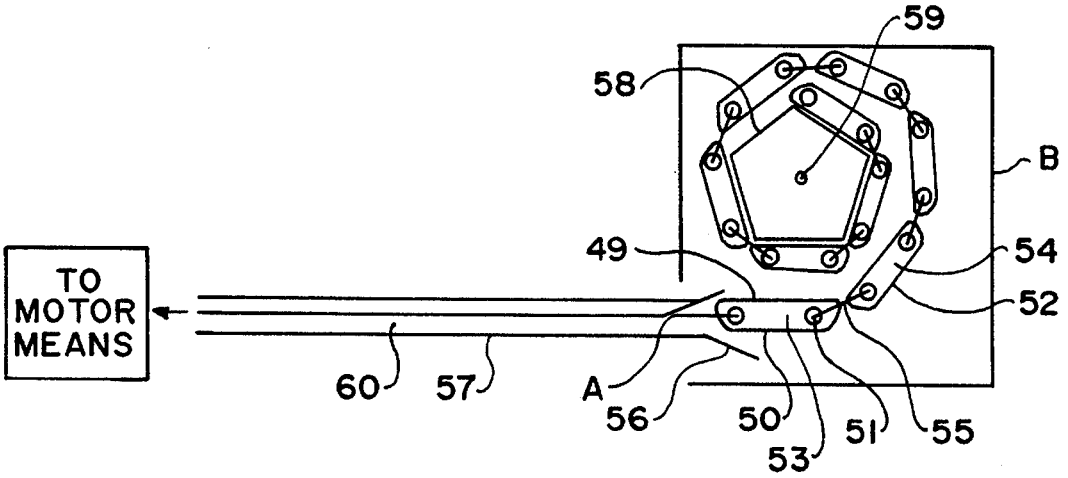
FIG. 8. This figure shows the side view of a sectional unit similar to the one shown in the previous two figures, except this unit is rotated over a central piece.

FIG. 8. This figure shows the side view of a sectional unit which basically is similar to the one shown in the previous two figures, except this view shows how these sections can be pushed or pulled to be rotated over a central piece (which in this figure has a pentagon shape) to take up less place for storage purposes (here shown B). This figure also shows that the individual pieces of these units are connected to each other and it also shows the schematic shape of a frame that with pulling will allow the sections to be kept straight to make a flat surface. The center piece has a pole in its center that can be rotated to facilitate turning of the units on it. In this figure the lower wall of the frame is shown by 57 and its side space of this frame by 60. The ramp for aligning the sections to go into the frame by 56, the pulling piece by A. The upper surface of the first section by 49 and the lower surface of it by 50. The rear wheel of the first section by 51, the connecting piece between the first and the second section by 55. The second section is shown by 54 and its lower surface by 52. The center piece with a pentagon shape by 58 and the center of this piece that can function as a rotating mill by 59. The outside chamber for holding this by B. This chamber can be made to be underground so that its outside can be covered by grass or flowers as well.

Figure 9:
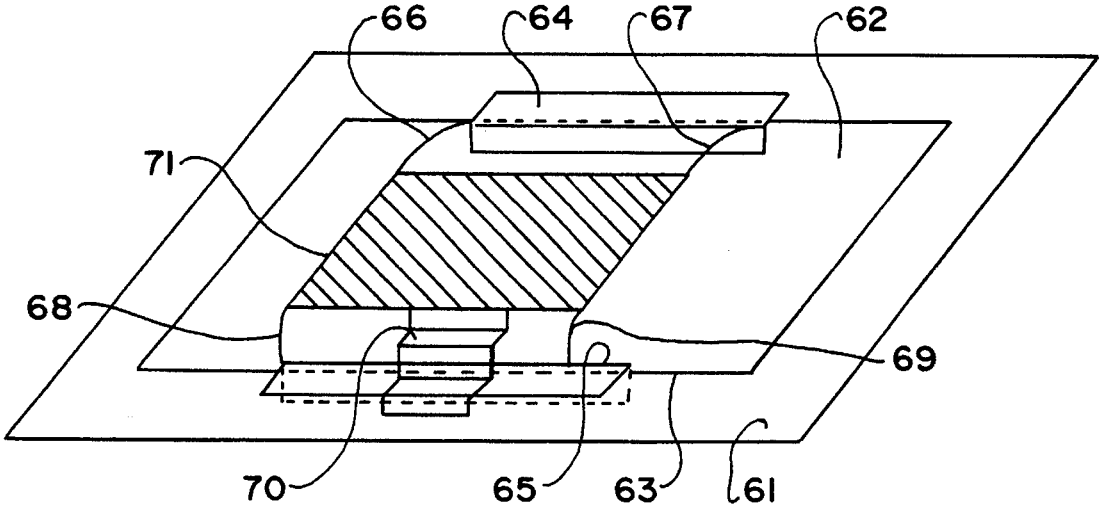
FIG. 9. This figure shows a deck that is placed over the top of a large in-ground pool.

FIG. 9. This figure shows a deck model that is to be placed or mounted on top of a large inground pool. This unit has two bases, each in the shape of a long right-angle piece of strong metal that has one horizontal wall to stand on the surface of the edge of the pool and one vertical wall to stand against the wall of the pool close to its edge. These pieces will fit and sit on the edge of the corner of the poles. These pieces will be the bases to hold the poles of the deck and allow the deck to be hold on the air by those poles. These rectangular pieces will dissipate the pressure of the poles. A set of stairs will allow the people to commute between the deck and the ground. In this figure the sidewalk of the pool is shown by 61 with the inner pool in middle by 62. The one corner shaped piece by 64 and the other one by 65. The stairs by 70. The poles by 66, 67, 68 and 69. These poles are holding the deck 71 shown by dashed lines in place. Importantly the connection of the pole to the corner piece namely pole 69 to piece 65 may be made from a hinge or a ball inside a matching cover in order to allow turning in multiple directions to occur to make it easily to be installed. Hinges may also be used in other connection places such as the connection of the surface and hinges to the poles. However naturally more pieces of securing pieces would be needed and will be used in such cases. The poles of this unit as well as frames will be designed to be adjustable even though the poles are in curved shape. Also they will be designed to be packed in a small space as well.

Figure 10:
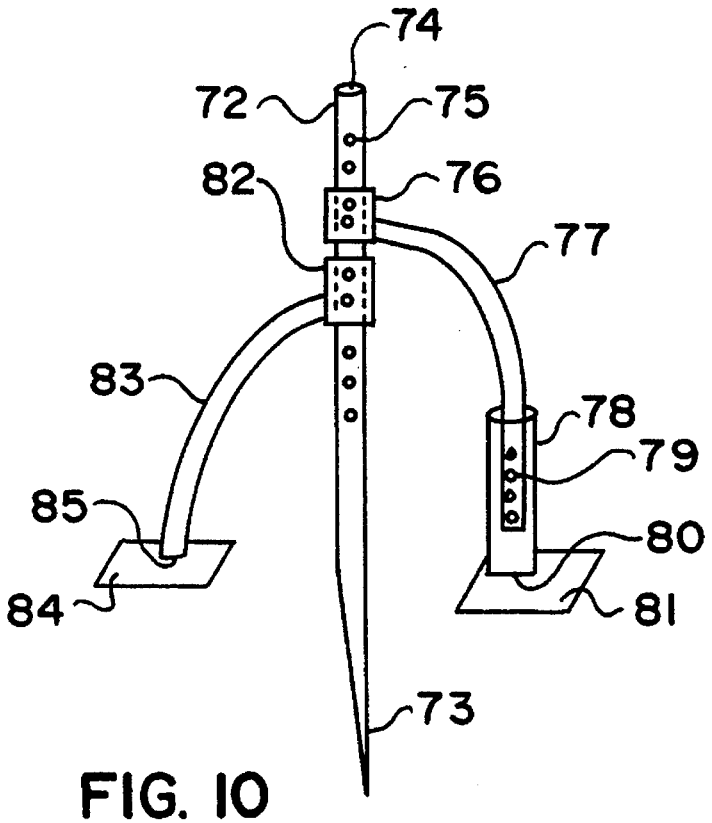
FIG. 10. This figure shows a special pole with its additional legs for providing more stability and support.

FIG. 10. This figure shows a special pole that has a design for providing more stability and support for the pole by having additional pieces that, like the legs, will stand on the ground or a surface to prevent the pole from being pulled toward the center to be dislodged from its original place. This example is shown to be used for tent bases, although it can be used in similar units as well. In this figure the center pole has a sharp end to go into the ground easily. It has an upper open end to accept the poles of the tent. There are side holes to allow the base of the extra leg to be fixed on this part.

The one leg in the right side has a base 81 to sit on the ground and an adjustable height. The leg in the left does not have an adjustable length; however, both of these units give the option of the place which they can be fixed on the main pole and this gives a significant degree of control of the distance to these pieces from the ground. Both of these units have a flat piece in the bottom which is hinged to the lower end of these legs and it increases the resistance at that side. In this figure the center pole is shown by 72 and its lower sharp end of the pole is shown by 73 the upper opening by 74 the side hole by 75. The right side leg by 77 with its connecting part around the center pole by 76. the lower end of this unit is placed inside a shell 78. This shell has holes shown by 79 to allow a metal bar to go through the shell and inner piece to allow the height of this leg to be adjustable. The hinge 80 connects this shell to the lower end flat piece of 81.

On the left, a similar unit is shown except it shows that the length of this unit is not adjustable. This piece has a shell 82 that goes over the center pole with holes on it for fixation. The body of this unit is shown by 38. The lower flat piece 84 is hinged to the body by hinge 85. When this piece is in place, the pole of the tent can be inserted inside the hole 74, and then other pieces can also be added to have a sturdy pole system to hold the tent easily and steadily.

Figure 11:
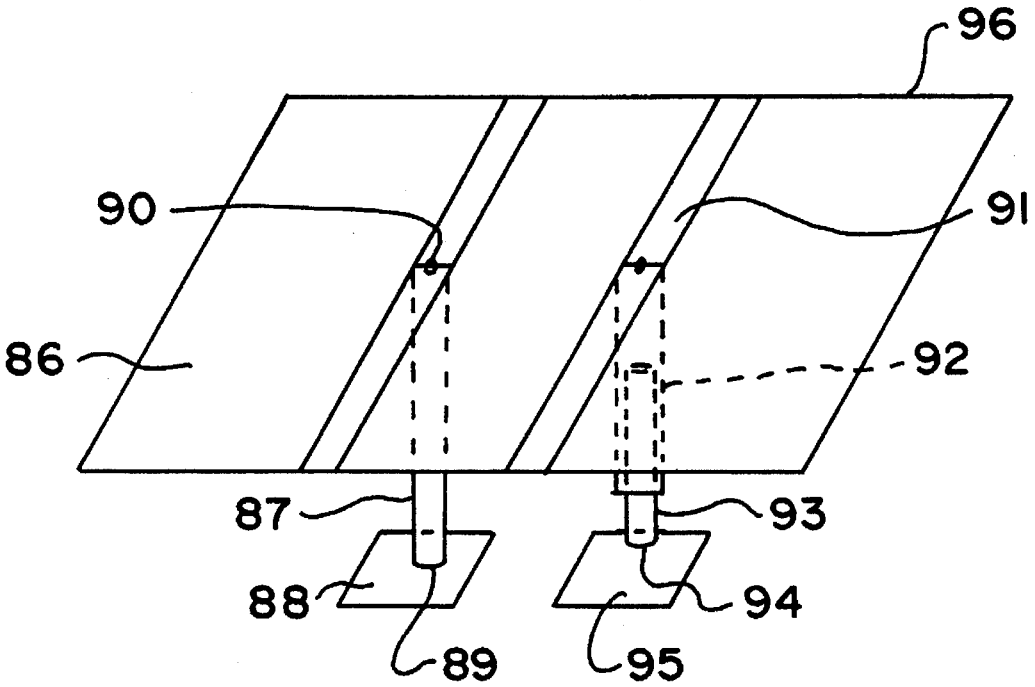
FIG. 11. This figure shows a frame of a unit to be used with the tents. This unit is to show how the base of such units can be fortified in order to prevent from the sagging of the floor and deforming or damaging it.

FIG. 11. This figure shows a frame of a unit to be used with the tents. This unit is to show how the base of such units can be fortified in order to prevent from the sagging of the floor and deforming or damaging it. For this purpose, units similar to the one shown in this figure will be utilized. These units have a strong bar to go from one side of the frame to the other one. This bar is to have a pole of its own that sits on the ground to prevent from sagging of this bar itself. There can be one or more bars so that overall, they will support the floor as strongly as needed. The poles will have an adjustable height, with a flat base that may be hinged to the lower end of the pole to allow the adjustment of the base of this pole with the angulation of the ground. In this figure the frame is shown by 96 one strong bar by 91 its pole 92 (which is hinged to the bar) and its lower piece by 93 which is inside the upper piece. The flat base with 95 and the connecting hinge by 94. The other pole 87 is also hinged to the bar by hinge 90 and its base 88 is hinged to the pole by hinge 89.

THE DETAILED EXPLANATION OF THIS INVENTION

Outdoor activities and livings are very refreshing and enlightening, they give many memorable times to us that last for a long time. Periods like having a good time on a deck in a nice weather, relaxing, having a tea or coffee with our friends and family or dining with them, to spending a good night in a tent are all a part of our unforgettable memories that should be included in everyone's life if they enjoy it. But such occasions can not happen when decks can not be set up temporarily in every place or not for a reasonable time and expenses. Sleeping in a tent can be worrisome to some grown ups and children when they consider about being attacked by insects and small animals that are able to walk easily to the tent which may tear and cause problems. Physical activities, exercises and plays such as tennis, basketball, volleyball etc. are also one of the most important and enjoyable parts of a healthy life, and many times the best things the people love to do. Unfortunately, such healthy exercise is not possible all the time because the needed grounds are not available in the convenience of being around our houses. It is true that many people can go to the parks or certain special places but the fact is that these are few and having such grounds in our home has an undeniable convenience which will promote the use if it was available. Many people such as myself would have made an exercise place in our back yard or a close by cheap piece of land if it was reasonably cheap and was not going to destroy the environment: so called the wild grass and flowers, small bushes etc. which in my mind are beauties and arts of nature or better said the creation of the God. But unfortunately making a Tennis court would need to destroy such pretty and extremely valuable pieces of nature and to eliminate a lot of grass forever. Once, when I discussed to have one to be made, the builder told me that he had to use special chemical to eliminate grass forever and this prevented me to have a playground made. It is disheartening to me to see the grass eliminated to be covered by asphalt. If this continues, the ecology of the whole planet may change over time and finally to cause a major problem, since the grass, weeds and the trees and even the small insects all have a major role in the ecology of the earth. They should not be disturbed as much as possible. Take the case of the decks, they can be very enjoyable but making them is not possible everywhere and are expensive as well. I want to mention another scenario about a person who has a limited place that can make either a pool or a deck. In general he has to sacrifice one of his wishes to get another one, that is not something we want, in a limited life why not to enjoy from the things that are totally acceptable and possible. Many of these thoughts made me to reach a solution and this application introduces a play ground and similar places that can be made on temporary basis; they are to be placed on the top of the grass, on top of driveways, above the pools etc, so the ground would not be disturbed permanently. Furthermore, there are other conditions that this invention will be very helpful; for example, in areas that the ground is uneven, the correction may not be possible or easy at all. A nice slope of land is not something that people are willing to allow it to be vanished for rest of the life in their home, or a creek is not something many people want to be touched and eliminated to have a play ground to be made. Then such a unit mentioned here with its adjustable poles will be the best alternative to make a nice playground in such circumstances.

The technique proposed here will use a permanent or temporary pole that will be made to be strong and to hold combinations of frames in an appropriate and sturdy shape and condition so that this frame will accept placement of pieces and units of appropriately shaped wood, plastic or steel or other synthetic hard materials on it, for making a flat, straight, sturdy surface to be used for many purposes. This surface then will be covered by other layers of soft materials to make it soft and friendly for the people to play. So that even a barefooted person could play on this grounds without being hurt. This will be done by having a layer or layers of soft material such as a cushion made from rubber or plastic or similar synthetic material to be laid on that surface of hard floor to function as an absorbent of the pressure as well as to help in filling some of the uneven areas due to its own structure and texture. This surface then may be also covered by another layer made from rubber or synthetic material or plastic or combinations of them to function as the finished surface of such a unit. This surface may have lines or fine spots of raised material on its surface to prevent from slipping of the person to occur, so it will make this perfect for playing.

So basically, this unit will be made from three important components: The poles, the frame, and flat surface covers, which will be explained as follows:

EXPLANATION OF THE POLES

These units will be a flat surface standing on the corner poles; or on a series of poles. In general, these poles will be sturdy strong units that naturally, their size, length and thicknesses will depend and match the size and nature of the unit that they are part off. These poles can be made to be used temporarily which are to be used for some period of time and then be taken from one place to another for different purposes such as storage or relocation. They may be made to be retracted or hidden in a space in the ground to be raised when desirable, or they can be a permanent structure that will be built to stay for a long time, to allow the frames and surface cover to be connected when needed. Some of the specifications will be as follows:

1. The temporary poles

In these cases the poles will be temporary and removeable from one place to another. In such cases they may be made to have combinations of three pieces: a top part or pieces, a middle part, and a lower part or pieces. This will allow the option of using these pieces separately as needed and desired.

a. The top part.

This will be a part that will accept and accommodate the frames. This piece will have one or more pieces to accept a number of frames (for example, one for the connection of the frame of one side and the other one for connection of the frame from the other side). The connection part of the top of the pole and the frames may have hinges so that they can be rotated for adjustment (the hinges have many uses for example in smaller models the side frames can be connected to be hinged to the body of the pole so that it can be rotated to come and stand next to the pole to make a smaller unit, for storage and transportation purpose etc.) and overall these top pieces will be designed so that from one side they will fit the top of the main body of poles (will be explained later) and from the other side they can accept ends of particular frames to hold them securely. Common means of tightening such as screws, special figures and connecting parts and methods will be utilized to have the top of the pole to be securely tightened to the ends of the frames to secure them together. These methods can be chosen to be of many types and easily designed that would not be mentioned here, since it will be boring to list them.

b, The middle pieces or the main body of the poles.

These are pieces that will stand between the upper and the lower ends and these pieces will be strong (relative to the size and heaviness of the load of the unit) and will also have an adjustable length, so that they can be shortened or lengthened. These pieces may be chosen to be long in some corners and short in the other corners as needed to allow setting a deck or a unit on an uneven surface or ground. They may be made to have an adjustable length such as making from pieces that one will slide into another, (FIG. 1) to be secured by a pin or a rod going thorough a hole in their walls, or having uni-directional motion to allow the pole to be pulled out but not to be able to go down unless a break is released (FIG. 2), this will be done by having a series of teeth in triangular shape in one side to allow the other side to slide and be pulled over it, but not to be able to come back due to a piece of metal held in position by a spring that will function as a brake until it is released. Many other methods also can be used such as inner pieces being rotated due to a screw technique, or to use of jacking techniques that are used to elevate cars, so the height of these poles will be adjusted easily to allow a desired level to be achieved, so that ultimately it will have a height which is desired, To allow a straight level surface to be built up on the frames.

c. The lower end piece.

These pieces are to allow the lower end to be fixed on a ground safely, simply and strongly. This piece or pieces can also be chosen independently, depending on the shape and hardness and nature of the ground or the place that this piece has to be placed. For example, on a level ground and soft place it will have sharp pieces to enter the ground and stay steady. Or it can be digged into the ground. In hard oblique places it can be oblique to match. If it is to sit on a wooden surface it can be flat to be screwed on the wood surface to be sturdy. So different shapes and forms will be chosen to make different models prepared for different uses.

2. The permanent poles

In such cases the poles will be placed permanently inside holes or openings or spaces inside or over the ground to stay. Such spaces will have appropriate covers to close the top of the opening of the ground where they are inserted and to be opened when needed. At the time of use, these poles can be pulled out either manually or by a motorized system, to be utilized.

So importantly, the height of such poles will be adjustable. When the poles are secured then frames will be mounted on them. In some models, the poles will be kept in place with the frames attached to them, to stay for optional use in any time it was desired. They may be constructed to be lowered and be kept inside a cradle in the ground until they are moved up to be used. In some cases the position of the poles will strengthened by connecting metal or wooden pieces or similar fastening and stabilizing pieces in order to secure their position next to each other when needed (this will be decided based on engineering rules and science). in order to secure their positions next to each other, and prevent from a disturbing motions.

It is also predicted that in order to prevent from instability of the poles, some other measures should be taken to prevent it. One of them that can be used in the case of setting tents is to have a sturdy support pieces or legs (FIG. 10 piece 77 and 83) connected to the poles to prevent from the poles to be tilted, loose and non functional. In such cases the main pole will have a sharp end on one side and an empty hole from the other side to accept the connecting piece from the upper poles of the tent. However, the body of the unit mentioned here will have a piece or pieces that is to go over the pole to provide more support to this unit and stability as shown in the FIG. 10. Also, there can be even further supports to the floor of tents and other models as well with incorporating pieces (such as 91 from FIG. 11) that will be more sturdy as well as having adjustable poles of their own (87, and 92–93 FIG. 11) to stand on the ground and prevent from bending and destruction of the floor of the tent or other units. Importantly: although in this example the tent is used, other models and decks may also use the same supports.

The frames

After the poles are securely placed, then series of frames will be positioned and connected to them in order to allow the pieces of boards to be placed on these frames to make the needed surface. These frames are to be made from strong materials such as steel, aluminium, fortified wood, hard plastic or similar materials or combinations of them. The larger the surface of the unit, the stronger the frames needs to be so that the motion on the surface due weight of the people or the objects or due to play would not disturb their alignments. The placement of the frames on the poles can be temporary or permanent. In some models and when the places are small, the frames can be temporarily placed and removed easily. If the surface of the needed place is big and the units are to stay for a longer period of time, then the frames may be made to stay for a period of time until they are disassembled.

The length and shape and size of these flames will be determined before use. However: importantly, in some units the length of these frames will be adjustable so that it can be changed to match the length or width of the area which they are intended to be used. After placements of the boards on these flames, a piece of metal or plastic may be placed over the flames to keep the boards securely.

In some cases it may be necessary to have pieces to come from one side of the frame to another side (FIG. 3 pieces 18 and 19) in order to make the frames sturdy and the surface to sag. In such cases, the connecting pieces will also be strong with their own extra poles so that overall, a strong sturdy network of frames will be made for usage and placement of the surface pieces and the boards.

The boards

After the flames are placed and secured by one way or another then series or units of boards will be utilized to stand on the flames so that ultimately the desired surface be made. Such boards may be made from different materials such as fortified woods, pieces of steel, aluminum or other metals, or any other suitable synthetic materials and combinations of them to make a sturdy and suitable units for this purpose. Like the other parts, such as poles and flames, naturally the latest available engineering science and methods will be used to make such units the best possible. In the cases of steel or aluminum cases pieces of same material or similar things will be used to be placed under their surface to prevent from deformation and motion and vibration of these boards to occur.

The boards will be made to have their ends to match and fit the shape of the particular frames chosen for that particular models. In simplest forms the board can be placed manually one next to another to cover the surface. Then a piece of specially shaped metal or plastic or similar unit will be placed over their ends on the frame to prevent from their motion and dislocation so that a flat, straight and reasonably stable surface would be made. Depending on the nature of this unit then, a desirable covering will be provided as well. For such purposes, one or more appropriate lining covers may be utilized to cover the hard surface of this unit to make it softer and likeable as desired. In the cases which such units are made as a play ground then, special lining will be utilized to cover the surface to make it the best possible for this use. For example, first a lining made from sponge or a layer of rubber will be utilized to give an even, reasonably soft surface, then another layer made from rubber or plastic will be used to make the surface a nice surface for play. This surface may have patterns of slightly raised spots or lines of rubber or plastic that will give a nice grip to shoes and fit and prevent from slipping etc. The pattern of the surfaces of these two covers may be chosen to match each other to make them reasonably secure to each other.

Importantly, in some cases the surfaces of the board may be already furnished with the needed covers to eliminate such a job to be done later. So that in general, a nice and likeable dining place or playground could be made to be enjoyed or a surface to be made for other uses.

Importantly, the boards may be designed to have holes to allow water and rain to go through in order to prevent from accumulation of water in the surface to occur. Alternatively they may be made to be tilted easily to allow the water to go through and be drained so that the rain will not prevent from their use as commonly happens in regular tennis courts in rainy places.

Further designs will be made to have the places for placement of needed pieces for special things such as basketball, volleyball, or Tennis nets or screens to be placed to allow it to be enjoyed. Special places for placement of poles to hold a screen around the place will be made to prevent from the balls to be lost, and surrounding area to be disturbed. Also in special cases, the tents poles would be placed on them. This will be very nice since it will make the job of setting up the tent easier and more sturdy.

Importantly, it is also possible to make boards that are adjustable so that their length can be changed and controlled by making pieces of them slide over the other, then to have screws or metal pieces to allow them to be fixed with the desirable length. These units can be made from metal, plastic or even wood.

Also, the sections of the board can be connected to each other by way of straps, bands, fabric or chains. These chains can be similar to chains of the bicycles that will be connected to the boards to connect them to each other and allow the sections to be ruled and go over a circular or polygon shape unit FIG. 8 no 58 to be stored. A narrower bands of boards may be connected over a fabric or bands to allow them to be ruled much easier for some uses such as covering the surfaces of the decks. This will allow them to be stored easily and spread easily as well.

Importantly these basic ideas and methods will be fortified and enriched with use of electric and electronic parts and powers, to diminish the labor and the manual job as much as possible. In one such model, the boards would be made in sections and to be connected to each other so that pulling or pushing of them from front or back would cause the motion of the others to follow; also the side ends of such boards will have bulbrings (Similar to the rings of the skates, to decrease friction) included with a design to fit inside the matching parts of the frames with skillful enginerings. So that it will allow sections of the boards to be pulled by a symmetric equal pulling or pushing to make the boards to spread much easily and to diminish the resistance and friction of the motion. The job of pulling/pushing of these sections can be also assigned to an electrically driven engine. So in practice, the skillfully constructed unit can be pulled/pushed by an appropriately made electrical engine controlled by a electrical/electronic devices so that pressing buttons or turning the knobs will cause the sectional boards to be pulled to spread and cover the surface of such a play ground. After this part is properly in place then another electrical engine will pull the center pole of a ruled cushion (not shown in picture) from the side ends of it so that the cover to role over the surface and to be evenly spread on the surface of the first surface. A round weight may be chosen to be ruled over the cushion to insure even spreading. Part of the job of this layer of cushion is to fill the uneven parts of the first surface in order to make it more even flat surface, although in some cases special rubber or plastic or similar pieces may be placed in such spaces or distances to make them even. Then a third layer will be ruled over the second layer in order to give a soft touch and to make an enjoyable surface to be used. The nature, shape, size, thickness, design and the numbers of such covers will depend to the nature of the unit that needs to be used and its size and related factors, and the state of the arts rules of engineering will be used to make them best. Again a roller may also be chosen to go over this cover to make it spread more evenly.

Special places will be made to allow needed poles for different games such as volleyball, basketball, and tennis to be placed on them. Also poles would be placed for mounting screens to be placed around this surface. Extra poles may be placed under certain spots connecting to a frame or frames which may be placed or located in the middle of the space or in regular and equally spaced spots of this unit to prevent from sagging the surface of the unit to occur and intermittent fortification may also be used for this purpose.

It is to be mentioned here that the job of pulling the boards and covers can be done by other methods: for example, the sides of the boards may have appropriate dentations to match a turning wheel from the frame side, so they can be engaged to move the boards by those rotating wheels in the side of the frames. This rotating wheel or wheels may also be placed connected to frames under the boards so that the turning wheels to be engaged with the matching dentations under the boards to move them. The dentations may be on a piece of metal or plastic or a band connected to the boards so these boards will be moved by one appropriate technique or another to move the boards mechanically. Also a chain, similar to the bike chain, may be used to move the sections. The connection of the sections to each other may be achieved by connecting them on a strong woven material so they can be rolled and rotated as well. Importantly, the sizes, length, thickness, length, structure, coloring, design and relative sizes of these boards may vary.

The amount of automatization will depend on the level of need of a person and how much a person would like this to be done: for example; a lady that does not have the strength of handling a big physical job may decide to have the unit fully automated, while a couple of young boys in a house may prefer to put all the boards in place in short time as a part of their physical activity. However, in general automated poles may also be made to raise from the ground easily, by using a technique such as rotation of the poles inside a matching shell or oil operated jacks or similar available techniques. Also these poles may have their connected frames so that these pieces can be all raised mechanically.

Therefore, importantly, by using these techniques units can be made that their height, length and widths can be adjusted easily to allow the people to enjoy, from playing on a ground to having a tea or dinner on a deck made by these technique, to relaxing and enjoying the fresh weather and the sun.

In order to make the sample model to be easily understood, a smaller prototype will be explained considering that a larger or bigger models can be made with some modifications of this small model, as well as adding a few of them together. In this prototype, four adjustable strong poles will be placed on the ground on the corners of a rectangle that has the desired size FIG. 5. They will be secured on the ground by one method or another. These poles will have an adjustable height as well as small pieces that can be placed on the top of the pole to adjust the height so that a flat level surface can be placed on them. Then a series of appropriately shaped frames made from steel, aluminium, plastic or similar strong material will be utilized and to be mounted on the poles so that these frames will be strong and sturdy. These frames may have levels incorporated on their sides for the convenience of easy measurements and adjustability. Levels (to find the straight level) are used so that the frames will be parallel. The special construction of such frames will allow them to accept series of pieces or units of boards so that finally a straight level will be made. The placements of the poles, frames and the boards can be done manually; and the boards many be placed one next to another, to make a nice even surface.

So this unit may be made to stand on the top of pools, or on the driveways or almost any other open spaces, as well as uneven places, even on the top of the houses.

The fact that these units can be temporarily made and are reversible and removeable is a major advantage. These units also have the advantages that it will not damage the ground permanently. They can be removed if the place is sold and the new owner wishes them removed, they can be used and then to be sold if someone decides to use this option and the revenue. They can be used seasonally, they can be installed in shorter times. All of these are major valuable options in the inventors opinion.

The body of the covers and sections may be properly placed inside an underground or above ground storage places. Also, interestingly, this unit prevents a big difficulty with the regular tennis courts and play grounds have after rain, that the water accumulates and prevents from use of the unit in desired times. This problem can be avoided at least in the fully automated cases when the rain is predicted the unit can be retracted easily in short time and to be opened later.

In some other models the pieces may be tilted or turned not to get wet. Also, as mentioned earlier, the boards may be made with holes to allow the water to pass through. In such cases the top covers can be ruled away during rain to allow them to be ruled over later when the weather is dry.

The play ground units can be made to be portable as well to be moved and placed on special places for tournaments or plays etc and then to be moved, some where else.

These units can be made in different shapes, sizes, strengths, and colors so that could be for many purposes. Decks, and tent units.

Importantly such units may be made to serve as a very useful unit for the other jobs such as making a deck in the middle of a yard for relaxation and enjoyment from the spring weather or making a unit for placement of a tent or screen so that a person can sleep under the blue sky and enjoy the fresh weather. Some may consider the comfort this unit can give to a family which some of their members may worry about sleeping inside the tent on the ground when there is a theoretical possibility of being attacked by small rodents and animals. In such cases, a flat surface can be made above the ground to allow the tent to be held on it easily. All of these can be done by a portable unit whose poles and frames and even the covering faces can be made to be packed in a portable sizes to be used temporarily and to be moved again easily when wanted or to be kept in small storage. The poles will be chosen to be more sturdy with having extra legs and supports, also to have openings for placement of aluminum poles that will allow the tent to be hooked to them and be set up easily. The floor of this tent may be covered by units of light-weight boards; these can be made from a series of light-weight narrow pieces made from aluminum that are as long as the width of the tents floor. These would be fortified due to their special design and construction to tolerate the weight of the person. The lower surface of these units may be connected to each other by series of straps made from synthetic fibers that will allow these boards to be rolled easily for easy spread and transportation. This unit would have a fortified frame as well to tolerate the weights. The strong flames will also allow connection of back supports like the back of benches to make sitting in the tents to be easier. Also, this floor cover, when particularly designed, will allow the middle part to be moved up to be used as a table and also to allow the legs to be dangled, again to make sitting much easier. Naturally, there should be a piece of soft fabric of the tent to drop down to make this unit a closed unit and to prevent from the insects to hurt the legs and come in. So the mid part of the soft floor of the tent would drop down for this purpose. These all will make the tent a more comfortable place to be used. Since in my experience sitting in the tent is usually very difficult and bothering for the back, but this system will make a unit similar to a picnic table for the people to enjoy.

Importantly, the decks may also be made to be motorized so that they may be stored in appropriate compartment and to have its frames and poles in place and whenever needed to have the boards to be moved on the frames to make the surface. The boards may be made to be sectional and an electric engine to drive them, back and forth.

The units to stand on the in ground poles.

For the homes with large inground poles a unit can be made to have poles that are connected to a base that has a corner shape (from connection of two rectangular pieces connected to each other along one long side.) that will fit on the corners or corners of the sides of the pole in each sides. So that the corners of the sides of the pools will support and hold bases of the poles. Then the unit will be held in one side by that corner pieces and in the other side by the edge of a rectangular frame so the pressure and weight of the floor on the frames will be pressed against the corner no 65 & 64 FIG. 9 and will hold them in place.

Importantly the connection of the poles to the corner piece namely pole 69 to piece 65 may be made from a hinge or a ball inside a matching cover or a double hinges in order to allow turning in multiple directions to occur to make it easily to be installed. Hinges may also be used in other connection places such as the connection of the surface and hinges to the poles. However, naturally more pieces of securing pieces would be needed and will be used in such cases. It will be appropriate to mention that in order to prevent the corner piece of 64 & 65 to damage the corner of the pole a lining of soft material such as sponges or rubber may be used to stand between these two rough pieces. State of the art engineering will be used to make these more safe and secure and likeable as well.

A set of stairs will allow walking up to the floor. The floor will be made from combinations of sets of boards that will stand securely on the frames and join to make a sturdy flat surface (this can be made from clear glass or similar clear material which will be a very interesting choice to allow the light to go through). It may be mentioned though that although the frames for such decks can be straight to stand close to the surface of the pool, however elevation of these decks has the advantage that at the time of use the heads of the people would not hit the deck. The edges of this unit as well as different parts of it may be illuminated and enlightens by series of lights to give a nice view at night and allow more beautification to occur for a pretty evening and night view.

The usefulness of such units is not limited to the models which were mentioned above and importantly, adjustable tables may also be made using such methods and techniques, which allows them to be stored and carried easily, so that at the time of use, it can be mounted to make a large unit with having the advantage that they can be set up in an uneven places such as outside on the grass and on a slope. In these units again, the height of each pole will be adjustable to make the height of the whole unit adjustable. The widths of these tables will also be adjustable by adjusting the length of the boards. The length of the table will be adjusted by adjusting the length of the frames (the frames will be adjustable to allow more boards to be placed on them) and use of more boards. So in general, there will be a table that can be set on an uneven place with its height, length and width to be as desirable as chosen, and can be carried in small pieces and stored in a reasonably small places easily, and this factor will be very useful for many people. Naturally, this unit will allow one side of the table to be higher/shorter than the other side for special uses (for certain displays etc. This technique, when used in some models, will allow an open place to be left in one side of this table or another side as well (this will allow some special thing such as trunk of a tree to be placed in the middle of this table etc.) adding for more choices. In smaller units special poles may be made with having the sides of the frames connected and hinged to it so that it will allow the process of setting up the table to be easy. These frames may be connected to each other by a screw so that it will allow the poles and frames of a table to be easily connected to each other so that they can be closed to be small when needed to be stored and opened easily to made the unit useable.

In practice, units of these models will be made to have every thing needed inside except the common tools, so that a person could buy a deck or play ground and fix it easily. Naturally the more complicated units would need an experienced person in this field to do the assembly. Although this unit is mentioned to make tables, desks, tent floors and the play grounds, however in fact any units that can be made with the suggested means and methods in this application will be made to allow the people to enjoy from them. Naturally the sizes, relative sizes of the pieces, colors, materials and designs of these units may vary to satify the needs of different units.

I claim:

1. A structure that comprises a structural framework supporting a generally horizontal floor vertically elevated relative to an outdoor ground surface on which said framework is adapted to be supported, said framework comprising a pair of horizontally spaced apart parallel rails, a plurality of structural floor members extending generally horizontally, mutually parallel, and transversely between said pair of rails, and being supported by said pair of rails, said structural floor members having generally flat rectangular top surfaces that are disposed side-by-side to form the bulk of the horizontal expanse of said floor, said framework comprising vertical poles extending downwardly from said floor and terminating in staking means adapted to be staked in the ground, and means coupling said structural floor members together for motion in unison along said rails.

2. A structure as set forth in claim 1 wherein said structural floor members are supported on rolling means that ride on said rails to allow said structural floor members to roll along said rails.

3. A structure as set forth in claim 1 in which said coupling means comprises means operatively coupling said structural floor members such that said structural floor members can be rolled to a storage position wherein said structural floor members are accordioned together such that said top surfaces thereof are generally vertically disposed.

4. A structure as set forth in claim 1 further including motor means for rolling said structural floor members along said rails.

5. A structure as set forth in claim 4 including a polygonally shaped hub that is rotated by said motor means and onto and from which said structural floor members are rolled and unrolled.

6. An elevated deck structure bridging spaced apart locations without any intervening support between those locations, said deck structure comprising a structural framework that rests on said spaced apart locations without resting on any intervening location between said spaced apart locations, a generally horizontal deck supported on said framework between and vertically elevated relative to said spaced apart locations, wherein said deck comprises one or more transparent structural members to allow light to pass through the deck, and further including a set of stairs extending between one of said locations and said deck to allow people to walk up onto the deck.

7. An elevated deck structure as set forth in claim 6 wherein said one or more transparent structural members is structural glass.

8. An elevated deck structure bridging spaced apart locations without any intervening support between those locations, said deck structure comprising a structural framework that rests on said spaced apart locations without resting on any intervening location between said spaced apart locations, a generally horizontal deck supported on said framework between and vertically elevated relative to said spaced apart locations, wherein said deck comprises one or more transparent structural members to allow light to pass through the deck, in which said deck is extendable over an in-ground swimming pool, said spaced apart locations are further locatable opposite sides of said pool, and including a set of stairs extending between one of said locations and said deck to allow people to walk up onto the deck.

9. An elevated deck structure as set forth in claim 8 wherein said one or more transparent structural members is structural glass.

* * * * *